United States Patent [19]

Guenther et al.

[11] 4,158,825

[45] Jun. 19, 1979

[54] WAVEGUIDE EXPANSION JOINT

[75] Inventors: Robert P. Guenther, Middletown, N.J.; Melvin S. Zucker, deceased, late of Long Island City, N.Y., by Ethel Zucker, administratrix

[73] Assignee: Bell Telephone Laboratories, Incorporated, Murray Hill, N.J.

[21] Appl. No.: 865,509

[22] Filed: Dec. 29, 1977

[51] Int. Cl.[2] ..... H01P 1/06; H01P 5/02; H01P 3/13

[52] U.S. Cl. ..... 333/257; 333/242; 333/260

[58] Field of Search ..... 333/98 R, 98 BE, 95 R, 333/95 A, 84 R, 96, 27, 97 R; 285/332.4, 383, DIG. 8, 163, 187

[56] References Cited

U.S. PATENT DOCUMENTS

| | | | |
|---|---|---|---|
| 2,522,279 | 9/1950 | Koller et al. | 333/95 A |
| 2,802,994 | 4/1954 | Ober et al. | 333/98 R |
| 2,951,222 | 8/1960 | Marie | 333/98 BE |
| 3,660,788 | 5/1972 | Alsberg | 333/98 R |
| 3,822,412 | 7/1974 | Carlin et al. | 333/98 R |

FOREIGN PATENT DOCUMENTS

| | | | |
|---|---|---|---|
| 530376 | 11/1976 | U.S.S.R. | 333/95 A |

*Primary Examiner*—Alfred E. Smith
*Assistant Examiner*—Marvin Nussbaum
*Attorney, Agent, or Firm*—Thomas Stafford

[57] ABSTRACT

An expansion joint for connecting sections of waveguide includes a plurality of spacer discs mounted on a plurality of guide rods. The guide rods are rigidly affixed to a termination member. Washer type springs are employed between the individual spacer discs on the guide rods for controlling increases and decreases in the space between the discs and, hence, compensating for contraction and expansion, respectively, of the waveguide sections while maintaining a uniform electrical path through the joint. Additional spacer discs having various thicknesses are also employed to allow for a predetermined maximum initial length adjustment within a prescribed tolerance.

6 Claims, 3 Drawing Figures

WAVEGUIDE EXPANSION JOINT

BACKGROUND OF THE INVENTION

This invention relates to millimeter waveguide transmission systems utilizing low loss circular electric modes of propagation and, more particularly, to an expansion joint for connecting sections of the waveguide.

Transmission systems employing waveguide which is rigidly supported within a surrounding conduit requires the use of expansion joints to accommodate for expansion and contraction of the individual sections because of variations in temperature. Even systems utilizing compliant continuous supports which may eliminate the necessity of expansion joints between the rigid waveguide sections still require expansion joints for connecting waveguide sections to sensitive repeaters and other termination apparatus.

One expansion joint known in the art utilizes mating tubular sleeves having a slip fit to join the waveguide sections. This prior expansion joint is known to present discontinuities and step functions to the transmitted signals which degrade transmission by generating undesirable spurious modes.

Another known prior expansion joint employs a properly configured dielectric member to transfer a signal across a joint in a trapped mode. This type of expansion joint is complex and, hence, undesirable.

In still another known expansion joint, first and second tubular members are employed which are mounted in a telescoping relationship. A bellows is employed in conjunction with the tubular members to allow variation in the length of the joint in response to thermal expansion and contraction. One problem with such an arrangement is that the bellows is extremely fragile and is easily ruptured. Another problem is the difficulty in manufacturing the bellows to obtain the desired precision needed in most waveguide applications.

SUMMARY OF THE INVENTION

These and other problems are resolved in accordance with the principles of the invention to be described herein in an expansion joint employed to connect sections of waveguide.

In one embodiment of the invention a first termination member is employed having a plurality of elongated support members rigidly affixed and disposed in predetermined relationship thereto. A plurality of first spacer members each having a center hole for wave propagation is movably mounted on the support members in prescribed relationship to the first termination member. Prescribed spatial separation between the individual first spacer members is realized by employing a plurality of resilient members disposed between the first spacer members on the elongated support members. The first termination member is adapted to be connected to a first transmission member, for example, a first waveguide section, diplexer or other termination device. A second termination member movably mounted on the support members and in predetermined registration with the first spacer members is adapted to be rigidly connected to a second transmission member, for example, a second waveguide section or the like. Expansion and contraction of the waveguide sections is compensated by the resilient members decreasing or increasing, respectively, the separation between the first spacer members. The initial space or separation between the first spacer members is adjusted so that, in response to expansion and contraction of the waveguide sections, the separation between the first spacer members may decrease or increase within prescribed limits without affecting the transmission properties of the waveguide system.

In another embodiment of the invention, a plurality of second spacer members is disposed on the support members in predetermined spatial relationship to the termination members. The second spacer members have predetermined thicknesses and are advantageously employed to allow for initial length tolerance adjustment of the expansion joint during installation. The thicknesses of the second spacer members are selected to allow for a predetermined maximum length adjustment within a prescribed tolerance. Then, by selectively removing individual ones of the second spacer members the length of the expansion joint is advantageously adjusted to compensate for variation in the initial position of the waveguide sections relative to one another or to termination equipment. The second spacer members need not be separated by resilient members.

BRIEF DESCRIPTION OF THE DRAWINGS

These and other objects and advantages of the invention will be more fully understood from the following detailed description and illustrative embodiments taken in connection with the appended drawings wherein.

DETAILED DESCRIPTION

Figure 1:
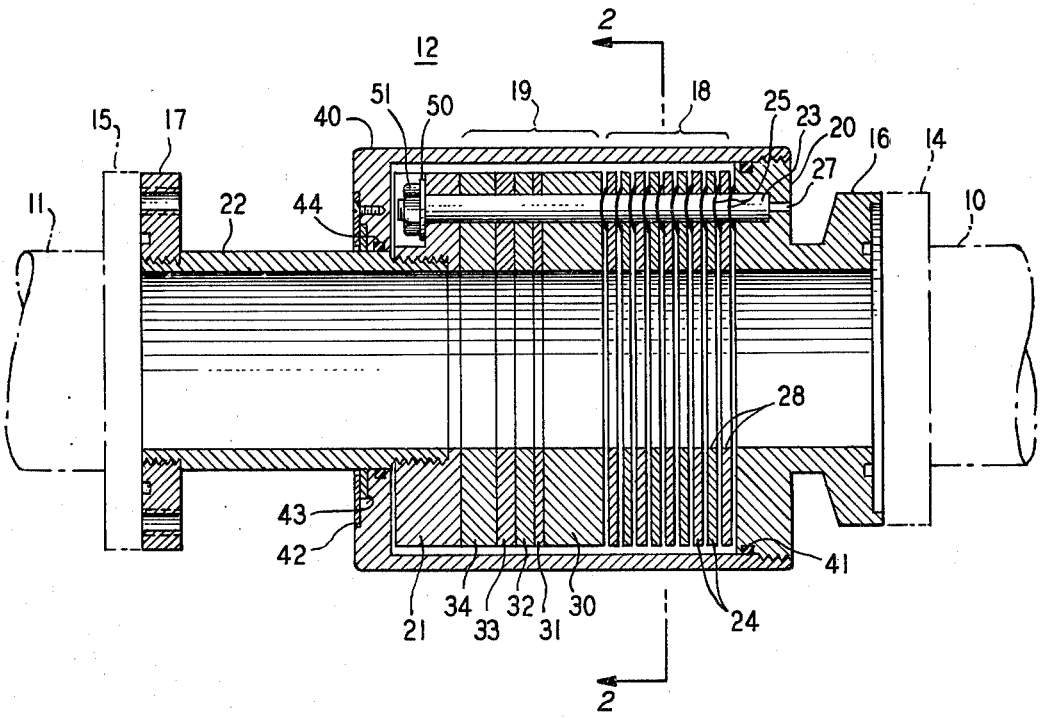
FIG. 1 is a longitudinal sectional representation of an expansion joint in accordance with the invention.

Referring now to FIG. 1, first and second transmission members, for example, circular waveguide sections 10 and 11, of a type intended to propagate waves in the $TE_{01}$ mode, are joined by expansion joint 12 illustrating one embodiment of the invention. In practice waveguide section 10 may be an integral part of a diplexer or the like. Expansion joint 12 as illustrated in FIG. 1 is in a fully expanded condition.

Waveguide sections 10 and 11 include flanges 14 and 15 which are connected to mating flanges 16 and 17, respectively. The respective flanges may be connected by any of several techniques known in the art, for example, welding, bolting or the like.

Waveguide section 10 and/or waveguide section 11 undergo expansions and contractions in their axial direction because of termperature fluctuations of the surrounding environment. These waveguide expansions and contractions are accommodated or compensated by compressions and expansions, respectively, of expansion joint 12 in accordance with one aspect of the invention. Additionally, during installation waveguide expansion joint 12 may, in accordance with another aspect of the invention, be advantageously adjusted in axial length to accommodate or compensate for initial length variations in and/or positioning of the waveguide sections relative to one another or to termination equipment. This feature simplifies installation of terminal equipment because of relaxed engineering and placement tolerances.

To this end, expansion joint 12 includes thermal expansion section 18 and initial length adjustment section 19 positioned between a first termination member, namely termination plate 20 including flange 16, and a second termination member, namely plate 21. Both plates 20 and 21 have a central hole of appropriate diameter to accommodate propagation of the $TE_{01}$ mode. Plate 21 is rigidly affixed via a threaded connection to a tubular member or sleeve 22 which, in turn, is affixed to flange 17.

Figure 2:
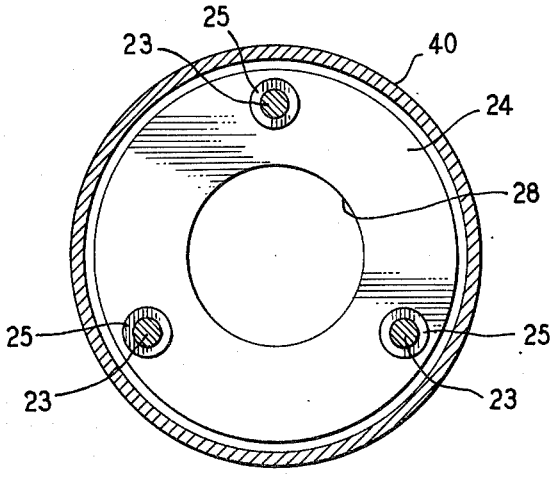
FIG. 2 is a view along section 2—2 of FIG. 1.

Mounted in plate 20 are a plurality of precision ground elongated support members or guide rods 23. Rods 23 are rigidly affixed in predetermined spatial relationship to each other and to plate 20 and are uniformly disposed at 120 degree rotation from one another. Thus, as shown in FIG. 2 three guide rods 23 are employed as supports, which are press fitted into precision holes bored in plate 20. Passages 27 allow air to escape during the press fitting of rods 23.

Guide rods 23 are employed to support movable spacer members of expansion section 18 and length adjustment section 19. Expansion section 18 includes a plurality of first precision cylindrical spacer members or discs 24 which are movably supported on guide rods 23. In this example, nine of discs 24 are shown which are maintained in prescribed spatial relationship by a plurality of resilient members or washer springs 25 (FIG. 2). Springs 25 (FIG. 1) are disposed between adjacent ones of discs 24 on each of guide rods 23 and are employed to allow spacer discs 24 to move on rods 23 in a manner to compensate for expansion and/or contraction of waveguide sections 10 and 11. Springs 25 are commercially available, for example, a U375-0110 from Associated Spring Corporation.

In one example from experimental practice, the total initial separation between discs 24 is adjusted during installation of the expansion joint to be approximately 0.036 inch (0.914 mm) and is adjustable between 0.011 inch (0.279 mm) and 0.061 inch (1.55 mm). The minimum spacing is the compressed thickness of springs 25. Thus, by employing in this example nine spacer discs 24 a total thermal adjustment is realized of approximately 0.500 inch (12.7 mm).

As shown in FIG. 2, each of discs 24 is a precision machined cylindrical element including center hole 28 for wave propagation and three outer holes to accommodate guide rods 23. The spacing of the outer holes relative to the center hole is such as to minimize the possibility of spurious wave generation. In an example from experimental practice, it has been determined that a precision machined disc having an outer diameter of 4.94 inches (12.548 cm), an inner diameter of 2.365 inches (6.007 cm), and support rod holes precisely drilled along a diameter of 4 inches (10.16 cm) is satisfactory for $TE_{01}$ wave propagation in 60 mm diameter waveguide with negligible spurious mode generation. It should also be noted that the spacing between discs 24 has also been selected to minimize undesirable mode generation in the expansion joint. Each of spacer discs 24 has a predetermined thickness and the dimensions are controlled for a desired precision thereby effecting uniform expansion and contraction without disturbing wave transmission. In this example, discs 24 are each 0.125 inch (3.175 mm) thick and the maximum separation between individual ones of spacer discs 24 is approximately 0.061 inch (1.55 mm).

Returning now to FIG. 1, initial length adjustment section 19 includes a plurality of second spacer members, namely, discs 30, 31, 32, 33 and 34. Length adjustment spacer discs 30–34 are identical to discs 24 except for thickness. The thicknesses of spacer discs 30–34 are selected to provide a desired maximum initial length adjustment of expansion joint 12. Different combinations of discs 30–34 yield different length adjustments as will be apparent to those skilled in the art. In this particular example, a length adjustment of up to 2 inches is provided by employing length spacers having thicknesses ranging from $\frac{1}{8}$ inch (3.175 mm) to $\frac{7}{8}$ inch (2.22 cm). However, in other applications larger or smaller initial length adjustments may be readily accommodated by employing length adjustment spacer discs having other desired thicknesses.

To insure a uniform center hole through expansion joint 12 for wave propagation the center hole in the spacer discs, termination member 20 and termination member 21 is initially of a diameter smaller than the precision diameter required to match waveguide sections 10 and 11. The spacer members and termination members are assembled and positioned in their proper order on guide rods 23. Spring members 25 are excluded. Then, the center hole through the spacers and termination members is line bored to the desired precise diameter thereby insuring a proper precise propagation passage through the expansion joint, as will be apparent to those skilled in the art.

Expansion joint 12 must also be capable of being pressurized. This is achieved by employing outer housing 40 which is rigidly affixed via a threaded connection to termination member 20. O-ring 41 insures a pressure seal between housing 40 and member 20. Since sleeve 22 must slide in and out of housing 40 the required pressure seal is realized by employing O-ring 44, and wiper 42 which is retained via ring 43.

Figure 3:
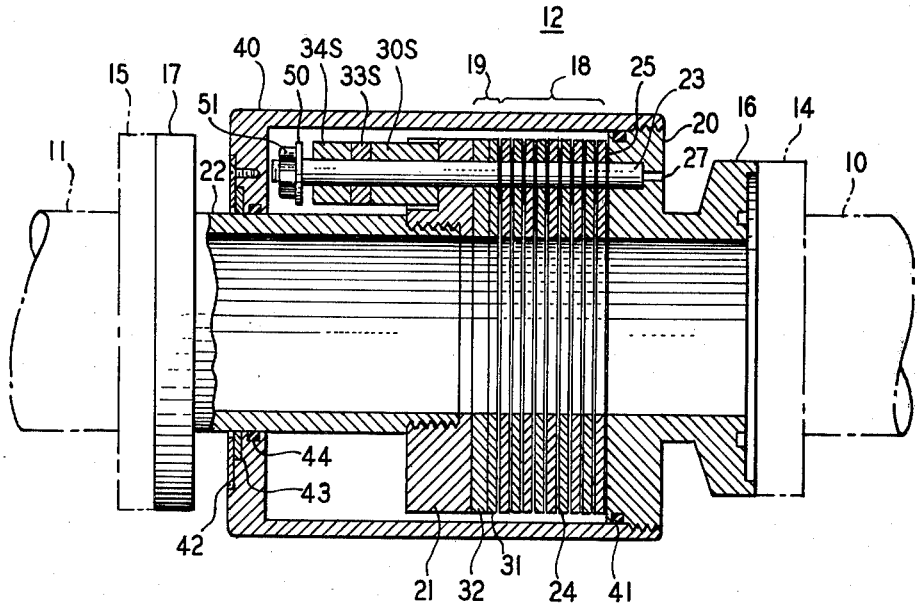
FIG. 3 is another longitudinal sectional representation of an embodiment of an expansion joint in accordance with the invention.

Thus, when waveguide sections 10 and 11 contract, sleeve 22 can slide out of housing 40 until termination member 21 substantially abuts washer 50 precisely positioned on each of guide rods 23 by a machined slot (not shown) and rigidly affixed thereto by nut 51 to yield a full expanded condition as shown in FIG. 1. Likewise, when waveguide sections 10 and 11 expand, sleeve 22 can telescope or slide into housing 40 compressing the space between discs 24 of thermal expansion section 18 until spring 25 are totally compressed. This condition is illustrated in FIG. 3. During both contraction and expansion of waveguide sections 10 and 11, and hence, expansion and contraction of the separation between discs 24, relatively uniform spacing between the individual ones of discs 24 is maintained by springs 25.

FIG. 3 shows another representation of expansion joint 12. Consequently, those elements or members which are identical to those shown in FIG. 1 and described above are similarly numbered and will not be discussed in detail again. Expansion joint 12, as shown in FIG. 3, is in a completely compressed condition thereby providing maximum compensation for expansion of sections 10 and 11. Additionally, several of the length adjustment spacers of length adjustment section 19 have been removed to demonstrate initial length adjustment of the expansion joint. For purposes of illustration, length adjustment spacer discs 30, 33 and 34 have been removed. When these length adjustment spacer discs are removed corresponding compensation spacer members must be added on each of guide rods 23 between termination member 21 and washer 50 and nut 51 in order to maintain the proper initial separation between the individual thermal expansion discs 24. Therefore, precision compensation spacer members having thicknesses equal to the thicknesses of the length adjustment spacers which are removed are employed to maintain the desired initial spacing and also the desired maximum thermal expansion. Thus, in this example, compensation spacers 30S, 33S and 34S are advantageously employed for removed length adjustment spacers 30, 33 and 34, respectively. In all other respects operation of expansion joint 12 shown in FIG. 3 is identical to that of the expansion joint shown in FIG. 1.

The above described arrangements are, of course, merely illustrative of the application of the principles of the invention. Numerous other arrangements may be devised by those skilled in the art without departing from the spirit or scope of the invention. For example, if it were desired or deemed necessary to have less separation between spacer discs 24 that was not substantially limited by the compressed thickness of springs 25, spacer discs could be employed each including a center hole for wave propagation, a first array of holes spaced equally around the center hole to be supported on guide rods, and a second array of somewhat larger holes also spaced equally around the center hole between the first holes. That is the first and second holes are alternately positioned. The discs are then oriented so that the first and second hole arrays of adjacent discs are rotated with respect to each other. Guide rods are then inserted through both sets of holes and each disc is supported by the guide rods extending through the smaller array of holes. Spring members are mounted on the guide rods so that they extend through the larger holes and engage alternate ones of the discs. The relative sizes of the holes and the springs are such that when pressure is exerted to compensate for thermal expansion of waveguide sections the springs are compressed, fitting into the larger holes. Consequently, minimum separation between the spacer discs is greatly reduced.

Furthermore, if greater expansion and/or initial length adjustment were desired additional spacer members may be added as will be apparent to those skilled in the art.

What is claimed is:

1. An expansion joint which comprises:

a first termination member adapted for connecting the expansion joint to a first transmission member;

a second termination member movably mounted in prescribed spatial relationship to said first termination member and being adapted for connecting the expansion joint to a second transmission member;

a plurality of elongated support members rigidly affixed to and in prescribed relationship with said first termination member;

a plurality of first spacer members each having a center aperture for wave propagation and being movably supported on said support members in prescribed spatial relationship with said first termination member; and a plurality of resilient members movably mounted on said support members between individual ones of said first spacer members, a resilient member being disposed on each support member in contact with an individual spacer member and an adjacent member thereby allowing for changes in the spatial separation between said spacer members to compensate for expansion and contraction of said transmission members.

2. An expansion joint as defined in claim 1 further including a plurality of second spacer members each having a center aperture for wave propagation and a prescribed thickness, said second spacer members being movably mounted on said support members in prescribed spatial relationship between said first and second termination members, wherein the thicknesses of said second spacer members are selected to provide a prescribed maximum initial length adjustment within a prescribed tolerance, whereby removal of selected ones of said second spacer members allows for adjusting the initial overall length of the expansion joint.

3. An expansion joint as defined in claim 2 further including means affixed to said support members for limiting movement of said second termination member relative to said first termination member thereby to limit the separation between said first spacer members.

4. An expansion joint as defined in claim 3 further including third spacer members having thicknesses corresponding on a one-to-one basis to said second spacer members and being selectively movably mounted on each of said support members between said second termination member and said limiting means when corresponding ones of said second spacer members are removed to adjust initial axial length of the expansion joint thereby to maintain appropriate initial separation between said first spacer members.

5. An expansion joint as defined in claim 4 wherein said first spacer members are cylindrical discs having a center hole for wave propagation and a plurality of support holes about a prescribed diameter.

6. An expansion joint as defined in claim 5 wherein said resilient members are washer springs.

* * * * *